United States Patent [19]

McArthur

[11] 4,169,589

[45] Oct. 2, 1979

[54] LEG EXERCISING APPARATUS

[76] Inventor: James A. McArthur, 1947 Penny Pl., Port Coquitlam, B.C., Canada

[21] Appl. No.: 837,460

[22] Filed: Sep. 28, 1977

[51] Int. Cl.[2] ..... A63B 21/00

[52] U.S. Cl. ..... 272/118; 272/DIG. 4; 272/134

[58] Field of Search ..... 272/118, 144, DIG. 4, 272/117, 134; 125/25 R

[56] References Cited

U.S. PATENT DOCUMENTS

| | | | |
|---|---|---|---|
| 3,112,108 | 11/1963 | Hanke | 272/117 X |
| 3,734,495 | 5/1973 | Nist et al. | 272/118 |
| 3,820,782 | 6/1974 | Salkeld | 272/118 |
| 3,917,262 | 11/1975 | Salkeld | 272/118 |

OTHER PUBLICATIONS

Athletic Journal - vol. 55, Dec. 1974, No. 4, p. 15.

*Primary Examiner*—Richard C. Pinkham
*Assistant Examiner*—William R. Browne
*Attorney, Agent, or Firm*—Larson, Taylor and Hinds

[57] ABSTRACT

Apparatus having a support on which a person can lie out flat, and laterally spaced elongated side members extending outwardly from an end of the support so as to extend along the outsides of the persons's legs from inner pivot points aligned with his hips. Each side member is formed of extensible inner and outer sections pivotally interconnected and having a foot pedal near the outer end of the side member. A resistor is connected to the side members adjacent the pivotal mountings thereof to resist movement of the foot pedals between an inner position when the person's legs are drawn towards the body and an outer position when the legs are extended. The resistor of each side member includes a cam mounted to rotate around the inner pivot point of said member, a surface on the cam positioned to move around this pivot point, a flexible connector adjustably connected to the cam surface, and a guide adjacent the cam surface over which the connector extends to a movement resistor preferably in the form of one or more weights.

24 Claims, 16 Drawing Figures

Fig. 1.
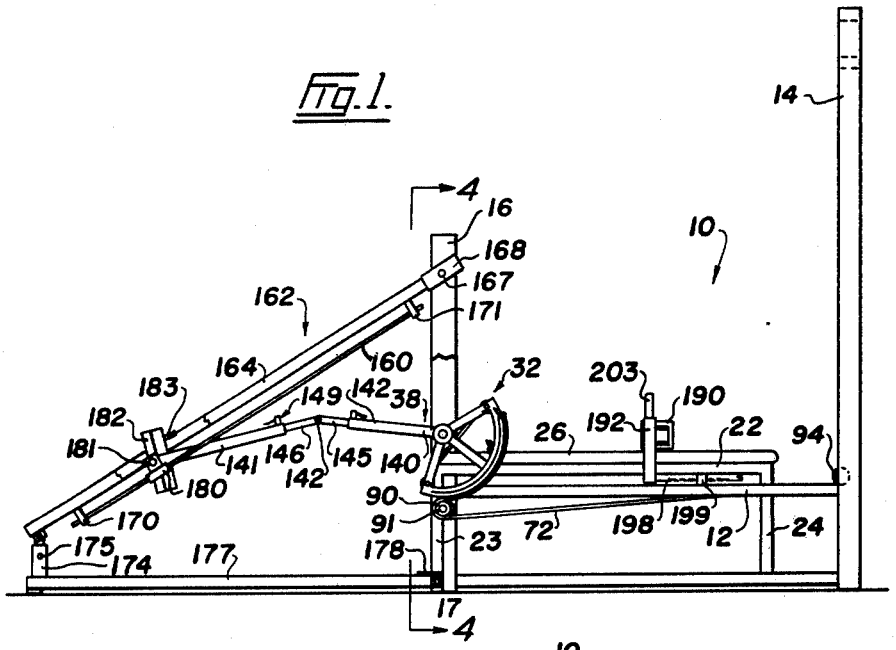
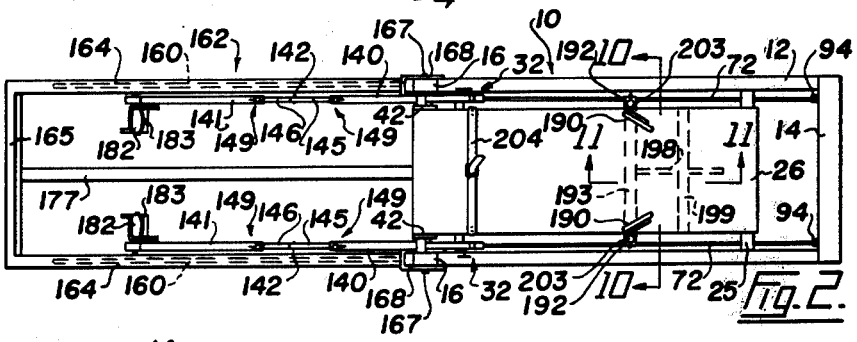
Fig. 2.
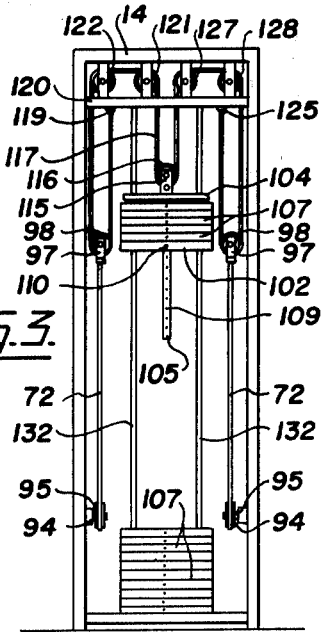
Fig. 3.
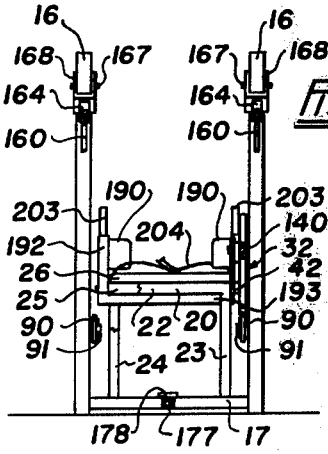
Fig. 4.

LEG EXERCISING APPARATUS

This invention relates to apparatus for use by human beings to exercise their legs.

The squat exercise as performed with barbells is probably the single most productive and beneficial exercise in resistance training, but it is also one of the most dangerous. In the squat, as well as in other multiple joint exercises, there exists a point where the resistance is maximum, and below or above this point it is less. During an exercise with a barbell, from the squat position, the start movement is very easy, in the mid range it becomes more difficult, and during the last part of the movement becomes easy again. Consequently, when chosing a weight for the squat exercise, a weight matching the mid range strength must be chosen, leaving the start and the finish of the exercise comparatively easy.

During conventional squat exercises, there is always the danger of the exerciser being crushed under a heavy weight, or of loosing control of the weight. Another problem is what is known as "lockout" in the extended position of the exercise. It is believed that a large percentage of squat-related knee damage occurs as a result of the increased joint compression and decreased muscle contraction resulting from the lockout position of the squat.

The present apparatus provides a squat exercise which is much more productive than the conventional means, it duplicates the natural body motion and provides a full range of resistance conforming to the strength curve of the body motion, and it eliminates the hazardous conditions inherent in the conventional squat with barbells. With the present machine, the variance in resistance exactly conforms to the constant changes in the ability of the individual to exert force throughout the full range of motion. This makes it possible for an individual to select a weight which requires a maximum effort at the start and as the exercise progresses, the resistance in effect is reduced and increased to conform with the natural strength curve. Consequently, substantially 100% muscular involvement can be achieve throughout the full range of motion.

There are some sitting leg press devices available employing various progressive resistance methods, but these devices only progressively increase the resistance. In other words, the resistance starts light and gets heavier as the legs travel towards the extended position. These are not squat machines, only leg press machines. On the other hand, the present machine provides true variable resistance in the multiple joint exercises.

With the present apparatus, it is possible to select the starting position of the squat exercise at any point throughout the full range of possible motion. It is also possible to exercise the legs independently of each other, alternately or at the same time. This feature produces balanced strength and further conforms to the natural alternate use of the legs.

Due to a special cam and linkage arrangement in this apparatus, an individual cannot lockout in the extended position of the exercise. During the performance of the exercise, the back is properly supported thereby eliminating the possibility of spine injuries due to uncontrolled twisting and bending.

Apparatus in accordance with this invention includes a support upon which a person can lie out flat. Elongated side members extend along the person's legs, and each side member is made up of inner and outer sections pivotally connected at adjacent ends. A foot pedal is mounted on the end of one section which constitutes the outer end of the side member while the opposite end of said member is pivotally mounted, said pivotal mounting being positioned where the hip joint of the person on the support can be aligned therewith. The side member sections are adjustable to fit legs of different lengths. Resistance means is connected to the inner ends of the side members to resist movement of the adjacent sections of the members around the pivot means thereof. It is preferably to provide adjustable shoulder stops on the support positioned so that the person can place his shoulders thereagainst. If desired, adjustable hand grips can be provided, these hand grips being positioned near the should stops.

The resistance means forms a very important part of this apparatus. The resistance means of each side member comprises a cam mounted to rotate around the inner pivotal mounting of said side member. This cam has a surface positioned to move around this pivot point, and a flexible connector is adjustable connected to the cam surface and extends around guide means adjacent said surface over which the connector travels when the cam is rotated. This connector wraps over the cam surface when the cam is rotated in one direction and unwraps from said surface when the cam is rotated in the opposite direction effectively to shorten and lengthen the connector respectively. Movement resistor means is connected to each connector to resist movement thereof while its connector is being effectively shortened by rotation of the cam.

Apparatus in accordance with this invention comprises a frame, a support on said frame upon which a person can lie out flat, and an exercise unit comprising an elongate side member formed in inner and outer sections, first means pivotally connecting adjacent ends of the sections together, second means pivotally connecting an outer end of the inner section to the frame, said second pivot means being positioned where the hip joint of the person on the support can be aligned therewith, a foot pedal near an outer end of the outer section upon which the person's foot can rest with his leg extending along the side member, and resistance means connected to said outer end of the inner section to resist movement of said inner section around said second pivot means.

A preferred form of this invention is illustrated by way of example, in the accompanying drawings, in which:

FIG. 1 is a side elevation of the leg exercising apparatus,

FIG. 2 is a plan view of the apparatus,

FIG. 3 is a back end elevation of the apparatus,

FIG. 4 is a cross section taken on the line 4—4 of FIG. 1,

Figure 5:
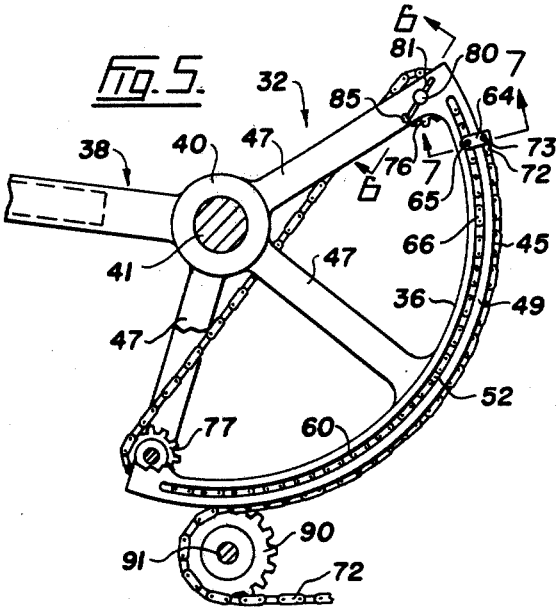
Figure 6:
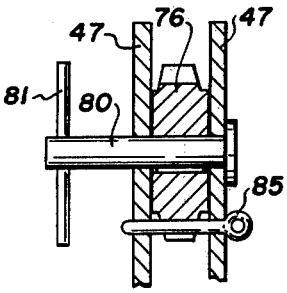
Figure 7:
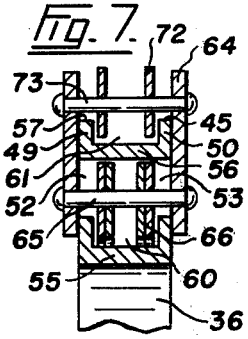
Figure 8:
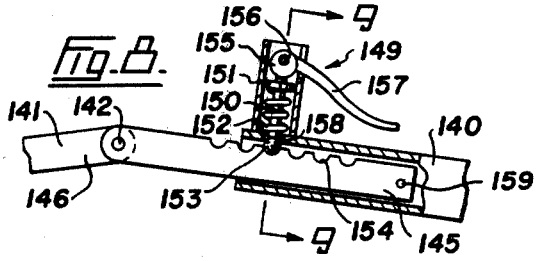
Figure 9:
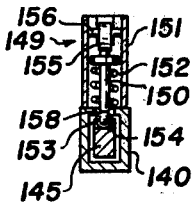
Figure 10:
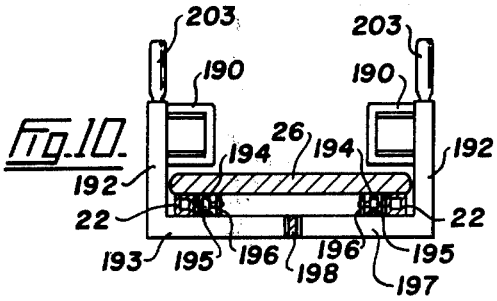
Figure 11:
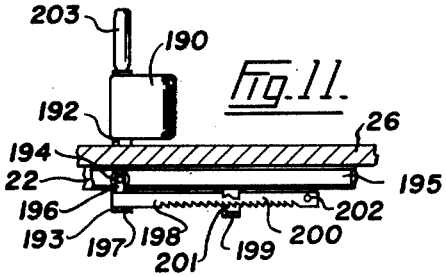
Figure 12:
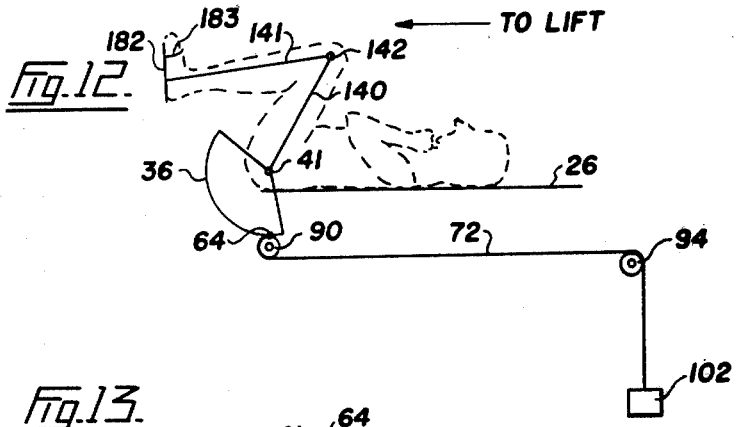
Figure 13:
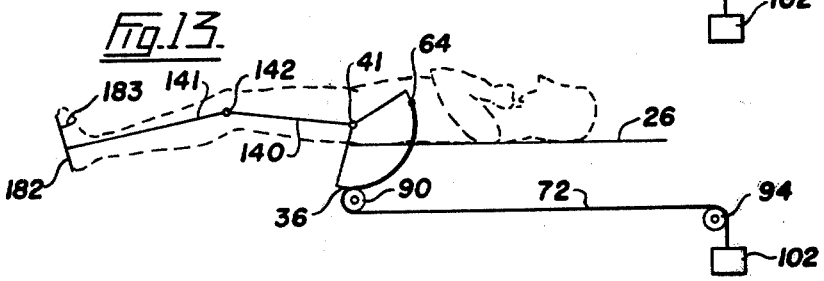
Figure 14:
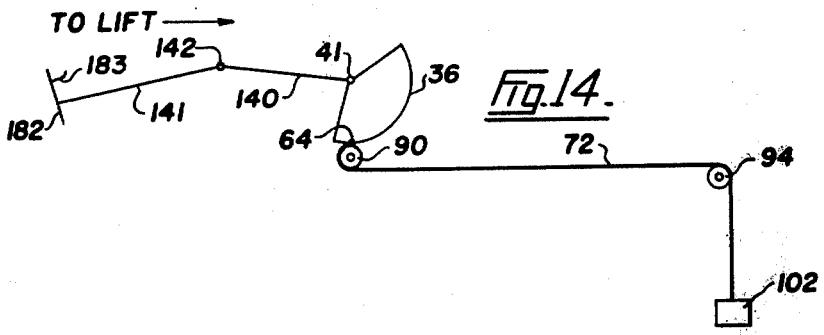
Figure 15:
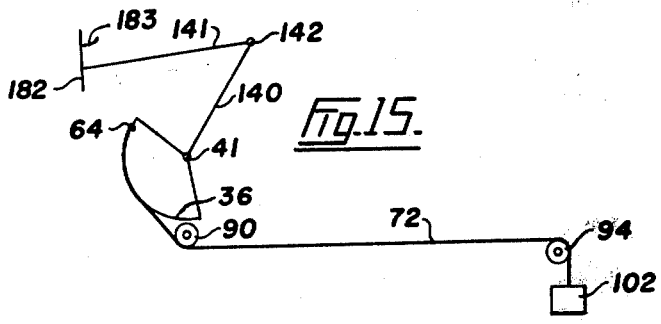
Figure 16:
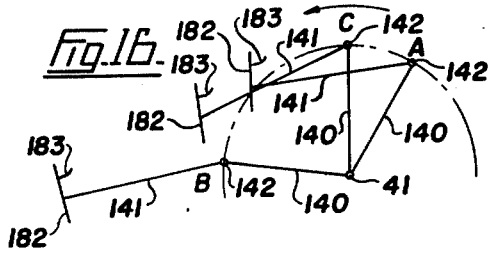

FIG. 5 is an enlarged side elevation of one of the cams in this apparatus shown with one setting at the beginning of a pressure stroke of the leg, FIG. 6 is an enlarged sectional view taken on the line 6—6 of FIG. 5, FIG. 7 is an enlarged section taken on the line 7—7 of FIG. 5, FIG. 8 is an enlarged detail of the interconnection between the inner and outer sections of one of the side members, FIG. 9 is a section taken on the line 9—9 of FIG. 8, FIG. 10 is an enlarged section on the line 10—10 of FIG. 2, FIG. 11 is an enlarged longitudinal section on the line 11—11 of FIG. 2, FIG. 12 is a diagrammatical view of a cam with one setting at the beginning of a leg pressure stroke, FIG. 13 is a view similar to FIG. 12 at the end of the pressure stroke, FIG. 14 is a diagrammatic view of the cam with a different setting at the beginning of a leg pull stroke, FIG. 15 is a view similar to FIG. 14 at the end of the pull stroke, and FIG. 16 diagrammatically illustrates the lever action that takes place with the cam setting as shown in FIGS. 12 and 13.

Referring to the drawings, 10 is a leg exercising apparatus in accordance with this invention, this apparatus including a frame 12 having a stand 14 at one end and a pair of laterally-spaced posts 16 at its opposite end. A bar 17 extends between posts 16 near the lower ends thereof. A horizontal support 20 is mounted within frame 12 and consists of horizontal side members 22 carried by front legs 23 extending upwardly from bar 17 and back legs 24 extending upwardly from another cross bar 25 extending between the sides of frame 12. A pad 26 is mounted on and extends the length of side members 22.

The illustrated exercising apparatus 10 includes two indentical exercise units 32 to enable two legs of a user to be exercised at the same. However, the apparatus could if desired have only one of these exercise units, which would not be as satisfactory as the present apparatus, but would enable one leg at a time to be exercised. As the two exercise units 32 are indentical, only one will be described in detail, and the same reference numerals are used in both units.

Exercise unit 32 includes a cam 36 mounted in a substantially vertical plane having a side member 38 connected thereto and projecting outwardly therefrom in the same general plane as the cam. Cam 36 is illustrated in detail in FIGS. 5, 6, and 7, and includes a central hub 40 journalled on a pin 41 which is carried by and extends between an adjacent post 16 and a lug 42 mounted on and projecting upwardly from support 20 at the front end of one side thereof. An inner end of side member 38 is rigidly secured to cam hub 40 and projects outwardly therefrom so that said side member is swingable on pin 41. The cam has a surface or edge 45 positioned to move around central point or pin 41. In this example, surface 45 is curved around hub 40 and is connected thereto by spokes 47. The cam surface or edge 45 is formed by spaced and parallel flanges 49 and 50, see FIGS. 5 and 7, having registering slots 52 and 53 therein extending substantially the length of the cam edge. An inner wall 55 joins the inner edges of flanges 49 and 50, see FIG. 7, and an outer wall 56 joins these flanges but is spaced inwardly from the outer edges 57 of said flanges. The wall 55 combines with flanges 49 and 50 to form an inner channel 60 while wall 56 combines with these flanges to form an outer channel 61 opening outwardly from the cam edge.

A slide 64 is mounted on cam edge 45 for movement along said edge. Slide 64 is connected by a pin 65 to a cable or chain 66 riding in channel 60, this pin extending through the slots 52 and 53 of flanges 49 and 50 of the cam. This cable is preferably in the form of a chain, as shown. A flexible connector 72 is connected through slide 64 in any suitable manner such as by means of a pin 73. Connector 72 is adapted to lie in outer channel 61 of the cam. Although this connector may be in the form of a cable, it is preferably a chain, as shown. Cam edge 45 forms a track along which slide 64 can be moved. Slide 64 is connected to the portion of chain 72 lying in channel 60. This chain extends from end to end of the cam edge, extends around sprockets 76 and 77 journalled on the end spokes 47 at opposite ends of cam edge 45, and extends directly between sprockets 76 and 77.

Sprocket 76 is fixedly mounted on a pin 80 which extends through spokes 47, as shown in FIGS. 5 and 6. This pin has a handle or knob 81 on its outer end by means of which the pin and sprocket 76 can be rotated. When sprocket 76 is rotated, chain 66 moves in channel 60 and shifts slide 64 along cam edge or surface 45. The slide can be locked in any desired position along each edge 45 in any suitable manner, and in this example, a pin 85 extends through spokes 47 and between two of the teeth of sprocket 76 as clearly shown in FIG. 6. When the pin is in this position, the sprocket cannot rotate, and, consequently, chain 66 cannot move. However, when pin 85 is withdrawn, the sprocket is free to rotate.

By referring to FIG. 1, it will be seen that the flexible connector or chain 72 connected to slide 64 of the cam extends outwardly therefrom around guide means in the form of a roller or sprocket 90 rotatably mounted on a pin 91 extending between lug 42 and the adjacent post 16 and beneath cam 36. The chain 72 extends rearwardly and around a sprocket 94 rotatably mounted on a pin 95 projecting from a side member of stand 14 near the lower end thereof. The chain 72 extends upwardly and is connected to a yoke 97 upon which another roller or sprocket 98 is mounted.

Resistance means is provided for each exercise unit 42, and this resistance means may be one or more springs, a friction creating element or, as preferred, one or more weights. In this example, a weight unit 102 provides common resistance means for the two exercise units 32.

Weight unit 102 consists of a horizontal bar 104 having a central rod 105 secured thereto and projecting downwardly therefrom, and any desired number of weights 107 having central holes therein can be placed on this rod. Rod 105 has a plurality of holes 109 therein, and a pin 110 is inserted through a lateral hole in the lowermost weight and through a rod hole 109 to retain the weights in position.

A yoke 115, secured to bar 104 and rod 105, carries a roller or sprocket 116 around which a cable or chain 117 extends. One end of chain 117 is anchored at 119 to a transverse bar 120 of stand 14 after having passed over sprockets 121 and 122 mounted on the stand, and around sprocket 98 to which one of the chains 72 is connected. The opposite end of chain 117 is anchored at 125 to bar 120 after having passed over sprockets 127 and 128 mounted on the stand and around the sprocket 98 to which the other chain 72 is connected.

Although weights 107 may be merely suspended from yoke 115 and rod 105, it is preferable to slidably mount these weights on a pair of vertical rods 132 mounted in stand 14. As shown in FIG. 3, there are a plurality of additional weights 107 slidably mounted on rods 132 at the lower ends thereof. When it is desired to increase or decrease the weight of unit 102, one or more weights 107 are secured to or removed from the central rod 105.

Each side member 38 is formed of inner and outer sections 140 and 141, respectively, hingedly connected together at adjacent ends thereof by a pin 142. The outer end of inner section 140 is fixedly connected to hub 40 of the adjacent cam 36 so that it is actually swingably mounted on pin 41.

It is preferable to make each of the side member sections 140 and 141 extensible, and in this example, these sections are hollow and have bars 145 and 146 slidably mounted therein and projecting from adjacent ends thereof, said bars being swingably connected by the pin 142. Identical latches 149 are provided for the sections 140 and 141. FIGS. 8 and 9 illustrate the latch 149 of section 140. The latch consists of a plunger 150 slidably mounted in a stand 151 mounted on projecting upwardly from the section 140, this plunger being biased downwardly by a spring 152 against a ball 153 resting on the bar 145 which has a plurality of depressions 154 in its upper edge for receiving said ball. An eccentric cam 155 mounted on a pin 156 carried by the stand has a handle 157 connected thereto and projecting outwardly over section 140. When this handle is swung downwardly, plunger 150 locks ball 153 in a selected one of the depressions 154. The plunger extends through a hole 158 in the upper edge of member 140, and a pin 159 projecting from bar 145 near the inner end thereof prevents the bar from being withdrawn from said member.

When it is desired to move the bar 145 inwardly or outwardly relative to section 140, the handle 157 is raised to free the plunger 150 so that ball 153 can roll over the upper edge of bar 145. When the bar is in the desired position with the ball in one of the depressions 154, handle 157 can be moved downwardly to cause cam 155 to lock the plunger and consequently the ball in this position, as shown in FIG. 8. Actually, bars 145 and 146 constitute adjustable ends of the inner and outer sections of the side members.

Although the outer end of each side member 38 may be free, it is preferably to provide guide or track means therefor. In this example, the guide or track means consists of a pair of rods 160, one for each side member 38, which can be connected at inner ends thereof directly to posts 16. However, it is preferable to provide relatively rigid support means for these rods. In the illustrated example, a rigid U-shaped member 162 is connected to posts 16. This support member has sides 164 interconnected at outer ends thereof by a cross bar 165. The opposite ends of sides 164 are hingedly connected to adjacent posts 16 by pins 167 which extend through these ends and through brackets 168 mounted on the posts. Each rod 160 is positioned below and extends parallel with a side 164 of member 162, said rod being supported at its opposite ends by hangers 170 and 171.

The outer end of support member 162 is carried by an extensible support 174. This support is held in any one of a number of adjusted positions by a pin 175 extending therethrough. The lower section of member 174 is swingably connected to the outer end of a base member 177, while the upper section of said support is swingably connected to the cross bar 165 of support member 162. The opposite end of base member 177 is fixedly connected by a lug 178 to bar 17 of frame 12.

Each track rod 160 is inclined outwardly and downwardly from near the upper end of one of the posts 16. The angle of incline of both of the track rods can be changed by extending or rectracting support 174.

A slide 180 is movably mounted on each track rod 160 and is pivotally connected by a pin 181 to the outer end of outer section 141 of the adjacent side member 38. A foot pedal 182 is connected to the outer end of said outer section 141 on the inside of the latter. If desired, the foot pedal may have a loop strap 183 under which a foot pressing on the pedal can fit.

A pair of shoulder stops or pads 190 are mounted on support 20 and spaced from cams 36. It is preferable to make these shoulder stops adjustable longitudinally of the support.

In this example, each shoulder stop is mounted on an upright end section 192 of a U-shaped bar 193. The bar 193 extends transversely of support 20 beneath the side members 22 thereof and the end sections 192 extend upwardly outside said side members. Bar 193 is suspended from a pair of rollers 194 riding on internal tracks 195 mounted on the inner surfaces of the two side members 22 of support 20, see FIGS. 10 and 11. Rollers 194 are carried by vertical lugs 196 projecting upwardly from the horizontal portion 197 of bar 193 adjacent the tracks 195. A ratchet bar 198 is connected to the horizontal portion 197 of bar 193 and extends rearwardly through a bracket 199 suspended from the side members 22. This ratchet bar has a plurality of ratchet teeth 200 on its lower edge adapted to engage a stop 201 carried by bracket 199. A stop pin 202 projects laterally from the free end of bar 198 to contact bracket 199 to limit the forward movement of the ratchet bar and, consequently, of shoulder stops 190.

When it is desired to move the shoulder pads 190 forwardly relatively to the apparatus, it is only necessary to shift the pads in that direction, at which time rollers 194 travel along tracks 195, and the teeth 200 of bar 198 ride over stop 201. If it is desired to move the shoulder pads in the opposite direction, the end section 192 of the U-shaped bar 193 are tilted forwardly, said bar swinging on rollers 194 at this time. This action raises the ratchet bar 198 to clear its teeth 200 from stop 201. The shoulder pads can now be moved rearwardly. When the pads are released, bar 198 drops back down so that a tooth thereof engages stop 201.

By referring to FIG. 2, it will be seen that the shoulder stops or pads are inclined relative to the longitudinal centre line of support 20. If desired, a hand grip 203 may be mounted on and project upwardly from each end section 192 of bar 193.

An adjustable abdomen belt 204 may be connected to the two side members 22 of support 20 near the cams 36, if desired.

When apparatus 10 is to be used, the exerciser lies out flat on support 20 with his hip joints aligned with the pivot pins 41 of the cams 36. Shoulder pads 190 are adjusted longitudinally of the support until they bear against the user's shoulders. If belt 204 is provided, it can be tightened over the user's abdomen. His feet are placed on pedals 182, and the lengths of the inner and outer sections 140 and 141 of side members 38 are adjusted by manipulating the latches 149 until said side members are approximately the same length as his legs with the pivot pins 142 aligned with his knees. During use of the apparatus, when either or both of the cams 36 are rotated in the appropriate direction, this movement is resisted by the weight unit 102 which is raised within stand 14. The weight unit is raised by movement of either or both of the cams, and the degree of movement of either one does not affect the movement of the other because of the fact that the cams are connected to the weight unit 102 by the chains 72 and chain 117.

When it is desired to exercise the legs from the squat position with the knees drawn upwardly towards the user's chest, as indicated in FIG. 12, the slides 64 are moved to one end of their respective cam edges 45 by rotating pin 80 by means of handle 81 after the lock pin 85 has been removed to release the adjacent sprocket 76. If it is desired to exercise the legs during movement from the straight out position back to the squat position, the cam slides are shifted to the opposite ends of the their respective cam edges, as in FIG. 14. The location of the slides at the ends of the cam surfaces are the extreme positions, but the slides can be shifted to intermediate positions along the cam edges in order to start the exercise between the extreme squat position and the leg extended position.

FIGS. 12 and 13 diagrammatically illustrate the most common excercise when the legs are moved from the squat position to the extended position while lifting the weight unit. The exercise starts from the position shown in FIG. 12, and as the legs are extended, the chains 72 travel around sprockets 90 and wrap over the outer surfaces of the cam edges until the legs reach the extended position, as indicated in FIG. 10. The legs are also exercised during the return movement thereof since the weight unit tends to rotate the cams around their respective pivot point, and this is resisted by the legs as they are folding back to the squat position. During movement of the side members 38, slides 180 move back and forth along tracks rods 160 to keep the feet in the proper position. The shoulders bear against pads 190 during the exercise, and the user can fold his arms back so that he can grasp the hand grips 202 just over his shoulders. This keeps his shoulders down on support 20 during the exercise.

The angle of incline of track rods 160 can be adjusted by changing the length of the extensible support 174 in order to change the effect of the exercise. When rods 160 are inclined downwardly as far as they will go, maximum effort will be required to start moving the legs from the squat position shown in FIG. 12. As the angle of the track rods is lessened relative to the horizontal, less starting effort will be required.

When it is desired to reverse the exercise, the slide 64 are shifted to the opposite ends of the cams. The exercise now starts with the legs extended and the feet under pedal straps 183, the action of the cams being shown in FIGS. 14 and 15. As the exerciser pulls his legs towards his chest, he pulls against straps 183 and lifts the weight unit 102 as the chains 72 are wrapped over the cam edges. As he moves his legs towards the extended position, he resists the action of the weight unit which tends to cause the cams to rotate to swing the side members towards the extended position.

One of the many advantages of this apparatus results from the fact that the slide 64 on one of the cams 36 may be moved to one end of its cam and the slide of the other cam cam be moved to the opposite end of its cam. With this arrangement, the legs can be moved alternately relative to each other from the squat position to the extended position. In this case, one leg tends to lift the weight unit as the leg is extended, while the other leg has to lift the weight unit as the leg is moved from the extended position to the squat position.

As the hips of the exerciser are located opposite the cam pivot points 41, and as his knees are opposite the pins 142 interconnecting the adjacent ends of the inner and outer sections of the side members, the legs travel in the same way they would move without this apparatus between the squat position and an upright position. The adjustability of the shoulder pads and the side members enable the apparatus to be adjusted to people of different sizes.

Another advantage of this apparatus is illustrated in FIG. 16 which shows the movement of a side member 38 and, consequently, the leg of the exerciser, from the squat position shown at A to the extended position shown at B. In this Figure, A represents the full squat position and B the full extended position. As is well known, the legs can exert maximum force for the first part of the movement from the squat position or from the extended position, but the movement under load at the intermediate position C is more difficult. However, it will be noted that at this intermediate point the inner section 140 of side member 38 extending from pivot point 41 is substantially at right angles to the direction of thrust of the user's legs. As a result, at this time the side member section is providing maximum leverage. The force being exerted by the user's legs against pedals 182 is substantially at right angles to side member section 140 which acts as lever. Thus, the cam and side member arrangement is such that maximum leverage is provided at the time the legs are able to exert only the least force. When the side members sections are in position A or position B, some of the energy of the legs is lost along lever sections 140. This variation in the weight resistance conforms exactly to constant changes in the ability of the individual to exert force throughout the full range of motion. This makes it possible for an individual to select a weight which requires maximum effort at the start, and as the exercise progresses the available leg power lessens but is offset by the increased leverage, after which the available leg power increases while the leverage effect decreases. As a result, approximately 100% musclar involvement can be achieved throughout the full range of motion.

Summing up, apparatus 10 provides the squat exercise without danger of injury to the user. It produces a better exercise than the normal squat exercise by conforming to the strength curve of the squat movement, making it possible to provide maximum intensity throughout the full range of motion. This apparatus duplicates the body motion and is adjustable to the individual body size. The starting position for each exercise can be selected at any point throughout the full range of motion, and the risk of lockout is eliminated.

I claim:

1. Apparatus for use by human beings to exercise their legs, comprising an elongate frame, a support on said frame upon which a person can lie out flat lengthwise of said frame, and an exercise unit comprising an elongate side member extending lengthwise of said frame and formed in inner and outer sections, first means pivotally connecting adjacent ends of said inner and outer sections together, second means pivotally connecting an outer end of the inner section to the frame and positioned where the hip joints of a person lying on his back on the support in a position lengthwise of said frame are substantially horizontally alignable therewith, a foot pedal near an outer end of the outer section upon which said person's foot can rest with his leg extending along the side member in a direction lengthwise of said frame, and resistance means connected to said outer end of the inner section to resist movement of said inner section around said second pivot means.

2. Apparatus as claimed in claim 1 in which said resistance means comprises a cam mounted to rotate around said second pivot means, a surface on the cam positioned to move around the second pivot means, a flexible connector, means connecting one end of the connector to said cam surface, guide means adjacent the cam surfaces over which the connector travels when the cam is rotated, said connector wrapping over the cam surface when the cam is rotated in one direction and unwrapping from said surface when the cam is rotated in the opposite direction effectively to shorten and lengthen the connector respectively, and a movement resistor connected to an opposite end of the connector to resist movement thereof while said connector is being effectively shortened by rotation of the cam.

3. Apparatus as claimed in claim 2 comprising means releasably securing said one end of the connector to the cam at selected positions along said cam surface.

4. Apparatus as claimed in claim 3 in which said guide means is so positioned relative to the cam that when the connector is secured to the cam near one end of the surface thereof rotation of the cam in one direction effectively shortens the connector, and when said connector is secured to the cam near the opposite end of said surface rotation of the cam in the opposite direction effectively shortens the connector.

5. Apparatus as claimed in claim 2, comprising means in at least one of said sections of the side member for adjusting the length of said member.

6. Apparatus as claimed in claim 2 comprising means in each of said sections of the side member for adjusting the length of said each member.

7. Apparatus as claimed in claim 2 comprising shoulder stops on said support positioned so that said person can place his shoulders thereagainst.

8. Apparatus as claimed in claim 7 in which said shoulder stops are movably mounted on the support for adjustment towards and away from said second pivot means, and comprising securing means for releasably fixing the shoulder stops relative to the frame.

9. Apparatus as claimed in claim 2 comprising hand grips on and projecting upwardly from said support and spaced from said second pivot means.

10. Apparatus as claimed in claim 9 in which said hand grips are movably mounted on the support for adjustment towards and away from said second pivot means, and comprising securing means for releasably fixing the hand grips relative to the frame.

11. Apparatus as claimed in claim 2 comprising track means connected at one end of the frame near and above said second pivot means and extending longitudinally away from the frame, a slide mounted on the track means for movement longitudinally thereof, and connecting means between said slide and the outer section of the side member near the outer end of said outer section.

12. Apparatus as claimed in claim 11 in which said track means is inclined outwardly and downwardly relative to the frame, and including means connected to said track means operable to adjust the angle of incline thereof.

13. Apparatus as claimed in claim 2 in which said movement resistor comprises a weight connected to an opposite end of the connector.

14. Apparatus as claimed in claim 2 in which said movement resistor comprises an adjustable weight connected to an opposite end of the connector.

15. Apparatus as claimed in claim 2 in which said resistance means comprises a cam mounted to rotate around said second pivot means, a surface on the cam positioned to move around the second pivot means, a flexible connector, means releasably securing an end of the connector of the cam at selected positions along said cam surface, guide means adjacent the cam surface over which the connector travels when the cam is rotated, said connector wrapping over the cam surface when the cam is rotated in one direction and unwrapping from said surface when the cam is rotated in the opposite direction effectively to shorten and lengthen the connector respectively, and resistance means connected to an opposite end of the connector to resist movement thereof while said connector is being effectively shortened by rotation of the cam.

16. Apparatus as claimed in claim 15 in which said cam surface comprises a track, and said securing means comprises a slide mounted for movement along the track, said connector being secured to the slide, and means releasably securing the side at different positions on the track.

17. Apparatus as claimed in claim 16 in which said cam surface comprises a track, and said securing means comprises a slide mounted for movement along the track, said connector being secured to the slide, guide means along the track, an endless cable carried by the cam, a portion of said cable extending through the guide means along the track, means securing the slide to the portion of the cable extending along the track, whereby longitudinal movement of the cable moves the slide along the track, and means connected to the cable for releasably securing said cable against longitudinal movement.

18. Apparatus as claimed in claim 15 in which said cam is mounted on the support to rotate in a substantially vertical plane.

19. Apparatus as claimed in claim 15 comprising a second exercise unit identical with said first mentioned exerciser unit, said movement resistor being connected to said opposite end of the connector of the second exerciser unit.

20. Apparatus as claimed in claim 19 in which the cams of the first and second exercise units are spaced apart and mounted on the support to rotate in substantially vertical planes, and the second pivot means of said cams being horizontally aligned.

21. Apparatus as claimed in claim 19 in which said movement resistor comprises a weight, and said apparatus comprising a vertical frame adjacent an end of said support, said weight being movable vertically in the frame, a secondary flexible connector extending over rotatable bearings on the weight and the frame and having opposite ends, and the connectors of the cams extending around rotatable bearings on the frame and connected through rotatable bearings to said opposite ends of the secondary connector.

22. Apparatus as claimed in claim 2 in which said guide means is so positioned relative to the adjacent cam that when the connector is secured to the cam near one end of the surface thereof rotation of the cam in one direction effectively shortens the connector, and when said connector is secured to the cam near the opposite end of said surface, rotation of the cam in the opposite direction effectively shortens the connector.

23. Apparatus as claimed in claim 1 comprising track means connected at one end of the frame near and above said second pivot means and extending longitudinally away from the frame, a slide mounted on the track means for movement longitudinally thereof, and connecting means between said slide and the outer section of the side member near the outer end of said outer section.

24. Apparatus as claimed in claim 23 in which said track means is inclined outwardly and downwardly relative to the frame, and including means connected to said track means operable to adjust the angle of incline thereof.

* * * * *